US005110144A

United States Patent [19]

Burton et al.

[11] Patent Number: 5,110,144

[45] Date of Patent: May 5, 1992

[54] CASING HANGER SEAL ASSEMBLY

[75] Inventors: James A. Burton; Rickey D. Book, both of Houston, Tex.

[73] Assignee: Cooper Industries, Inc., Houston, Tex.

[21] Appl. No.: 573,630

[22] Filed: Aug. 24, 1990

[51] Int. Cl.[5] ..... E21B 33/04; E21B 33/128

[52] U.S. Cl. ..... 277/116.2; 277/236; 277/117; 166/208; 166/182; 166/115; 285/140; 285/917

[58] Field of Search ..... 277/116.2, 117, 207 R, 277/208, 213, 214, 215, 236; 285/140, 917; 166/115, 182, 208

[56] References Cited

U.S. PATENT DOCUMENTS

| | | | |
|---|---|---|---|
| 3,273,646 | 9/1966 | Walker | 166/86 |
| 3,404,736 | 10/1968 | Nelson et al. | 166/85 |
| 3,797,864 | 3/1974 | Hynes et al. | 285/140 |
| 4,131,287 | 12/1978 | Gunderson et al. | 277/236 X |
| 4,496,162 | 1/1985 | McEver et al. | 277/9.5 |
| 4,521,040 | 6/1985 | Slyker et al. | 285/140 |
| 4,572,515 | 2/1986 | Grazioli | 277/12 |
| 4,588,030 | 5/1986 | Blizzard | 277/236 X |
| 4,615,544 | 10/1986 | Baugh | 285/18 |
| 4,665,979 | 5/1987 | Boehm, Jr. | 166/208 |
| 4,691,780 | 9/1987 | Galle, Jr. et al. | 166/208 X |
| 4,742,874 | 5/1988 | Gullion | 277/236 X |
| 4,747,606 | 5/1988 | Jennings | 285/917 X |
| 4,749,047 | 6/1988 | Taylor | 166/182 X |
| 4,771,828 | 9/1988 | Cassity | 277/236 X |
| 4,771,832 | 9/1988 | Bridges | 277/236 X |
| 4,790,572 | 12/1988 | Slyker | 277/117 X |
| 4,815,770 | 3/1989 | Hyne et al. | 285/140 |
| 4,823,871 | 4/1989 | McEver et al. | 277/116.2 X |
| 4,832,125 | 5/1989 | Taylor | 277/236 X |
| 4,911,245 | 3/1990 | Adamek et al. | 277/236 X |

FOREIGN PATENT DOCUMENTS

| | | | |
|---|---|---|---|
| 0044138 | 3/1990 | Japan | 277/117 |

*Primary Examiner*—William A. Cuchlinski, Jr.
*Assistant Examiner*—James K. Folker

[57] ABSTRACT

The present invention relates to an improved seal assembly for sealing between the interior sealing surface of a well housing and the exterior sealing surface of a hanger landed within the well housing and includes a seal body having a pair of outer lips diverging outwardly for sealing against the housing interior sealing surface and an interior series of annular ridges which have a diameter smaller than the outer diameter of the hanger exterior sealing surface, an upper energizer and a lower energizer for coacting with said lips to move the lips into sealing position and to store the energy of setting to ensure sealing engagement of the lips. In some forms of the invention the energy is stored by virture of the lips being of a relatively low yield stength material as compared to the energizers which have a higher yield strength. Also, structure is provided in some of the forms of the invention to store both radial and axial lip loading forces.

12 Claims, 6 Drawing Sheets

CASING HANGER SEAL ASSEMBLY

BACKGROUND

The present invention relates to an improved wellhead structure which is particularly adapted to subsea wells. Such structure includes a wellhead housing and an improved hanger and seal assembly which can be landed and set in a single trip.

Prior to the present invention many efforts have been made to provide a satisfactory hanger and seal assembly which allows the landing of the hanger, cementing and the setting of the seal in the annulus between the exterior of the hanger and the interior of the housing.

The R. W. Walker U.S. Pat. No. 3,273,646 discloses a hanger and seal assembly in which a snap ring is used to engage within a groove within the interior of the housing and the seal is run in the annulus above a port which allows the circulation of cement to proceed before the seal is set responsive to rotation of the setting sleeve to force the seal downward below the port and to land on a shoulder against which it is compressed axially to cause it to expand radially and seal across the annulus.

The B. H. Nelson et al U.S. Pat. No. 3,404,736 discloses an annulus seal in which the seal is positioned within the annulus and held in the unset position by a shear pin. The rotation of the setting sleeve causes the pin to shear and the seal and wedge ring to move downward to set the holddown ring and to compress the resilient seal into sealing engagement with the walls of the annulus.

The J. H. Hynes et al U.S. Pat. No. 3,797,864 discloses another annulus seal which is set by rotation to compress the seal axially. This seal assembly includes end rings with marginal lips which engage the end of the elastomeric seal and when the seal is compressed the lips are deformed into metal-to-metal sealing engagement with the walls of the annulus. The Slyker et al U.S. Pat. No. 4,521,040 discloses a modification of the Hynes et al structure.

Another hanger seal which is set by threading a nut on external threads of the hanger includes a seal body having a plurality of outer metal fins extending outwardly and downwardly and having elastomeric material between the fins, a plurality of inner metal fins extending radially inward and having elastomeric material between the fins and a connection between the seal body and a lower body having an upstanding rim which when the bodies are forced together sets the outer seal legs. Another hanger nut thread set seal includes both inner and outer seal legs which diverge and are loaded by inner and outer rims on the upper body and lower body to set all four seal legs into sealing engagement with the walls of the housing-hanger annulus.

Other prior patents have utilized metal end caps for an elastomeric annulus so that on setting of the seal by compression, the lips of the end caps engage the walls of the annulus to both seal and also protect against the extrusion of the elastomeric material. An example of such structure can be seen in the U.S. Pat. No. 4,496,162 to McEver et al (movement of the seal ring onto enlarged diameter portion of hanger sets the seal ring into sealed position).

The B.F. Baugh U.S. Pat. No. 4,615,544 discloses another type of annulus seal which is set by rotation of a setting sleeve. The seal includes a Z-shaped portion having a plurality of frustoconical metal rings positively connected by links and the grooves formed by the rings being filled with resilient elastomeric members. The seal is set by axial compression which forces the inner and outer ends of the rings and the resilient members into sealing engagement with the walls of the annulus to be sealed.

U.S. Pat. No. 4,572,515 to A. J. Grazoli discloses a seal for sealing between the walls of a seat ring and body in a ball valve. The seal is a ring of polytetrafluoroethylene which includes spaced apart, outwardly diverging sealing lips for sealing against the wall of the body and outwardly diverging sealing lips for sealing against the wall of the seat ring.

Another prior structure is shown in U.S. Pat. No. 4,823,871 wherein the seal assembly included outer lips flaring outwardly from the seal body and having a resilient member between such lips and inner lips which flare inwardly and towards each other with a resilient member between such inner lips. The seal assembly includes structure which exerts a force on at least one of the outer lips to urge it outwardly about its base connection of the seal body into tight sealing engagement with the interior of the housing. The inner lips have a free diameter which is less than the outer sealing surface of the hanger against which they are to seal and thus the movement of these inner lips onto the hanger sealing surface brings them into sealing engagement with the hanger sealing surface.

SUMMARY

The improved structure of the present invention relates to an improved hanger seal assembly for sealing between a hanger and a well housing. The hanger is landed within the well housing before the seal assembly is moved into sealing position between the housing and the hanger. The seal assembly is lowered into sealing position between an external hanger sealing surface spaced from the internal housing sealing surface which is defined within a recess on the interior of the well housing and includes a seal body having external metal sealing lips diverging outwardly but having an initial free diameter less than the diameter of the housing internal sealing surface and internal metal sealing surfaces on the inner surface of the body having a free diameter smaller than the diameter of the hanger external sealing surface, a lower energizer ring movably connected to the seal body and having an upstanding rim which stores the force created by its engaging and moving the lower outer sealing lip to its set position, an upper energizer ring movably connected to the seal body and having a depending rim which stores the force created by its engaging and moving the upper lip to its set position. The upper and lower sealing lips are of an annealed or soft metal while the upper and lower energizer bodies are of a high yield strength metal so that the loading force on the lips can be stored and maintained after they are set into sealing position. The interior projections which provide the interior sealing are spaced along the interior of the seal body by recesses which are either sufficiently deep to avoid problems with liquids trapped therein during setting or have a liquid exclusion material therein. Means for securing or locking the seal assembly and the energizer rings in their set position is included and such securing means includes means for engaging within grooves on the exterior of the hanger and on the interior of the housing. In all forms of the invention there is provided some means for storing the lip setting force and this may include the storing of both axial and radial forces generated for setting the sealing lips.

An object of the present invention is to provide an improved hanger seal assembly for use within a wellhead housing with improved metal-to-metal sealing against the inner and outer surfaces of the hanger-housing annulus and which stores the setting energy to retain the metal-to-metal seal.

Another object is to provide an improved hanger seal assembly of the type described in which the sealing load on the outer sealing lips is maintained after the lips are set in their sealing positions.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENT

Figure 1:
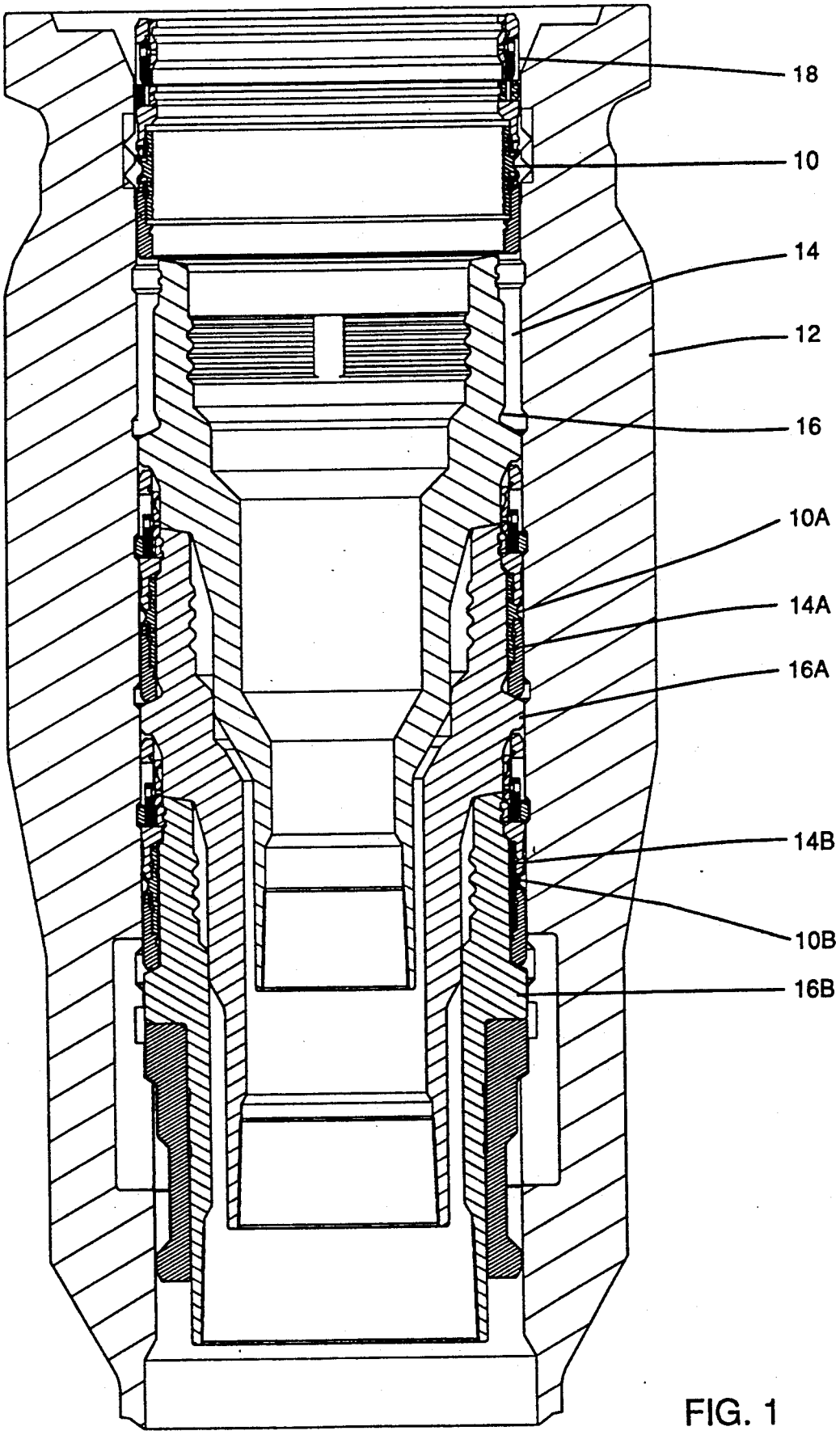
FIG. 1 is a sectional elevation view of a hanger landed within a well housing and the improved seal assembly of the present invention being in position for lowering into sealing position across the annulus between the hanger external sealing surface and the well housing internal sealing surface.
Figure 2:
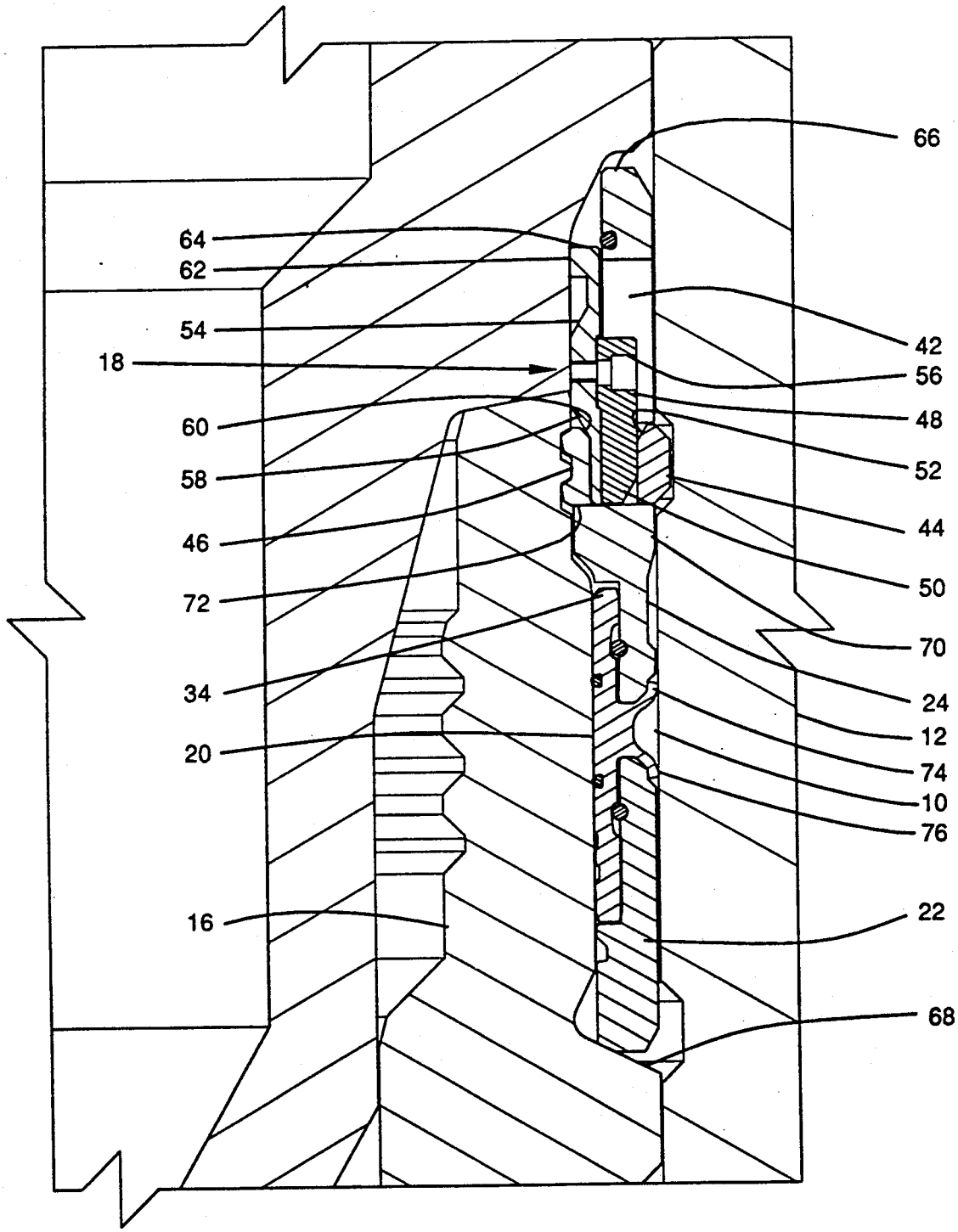
FIG. 2 is a partial sectional view illustrating the seal assembly in its landed and set position in the hanger-housing annulus with another hanger landed therein.
Figure 3:
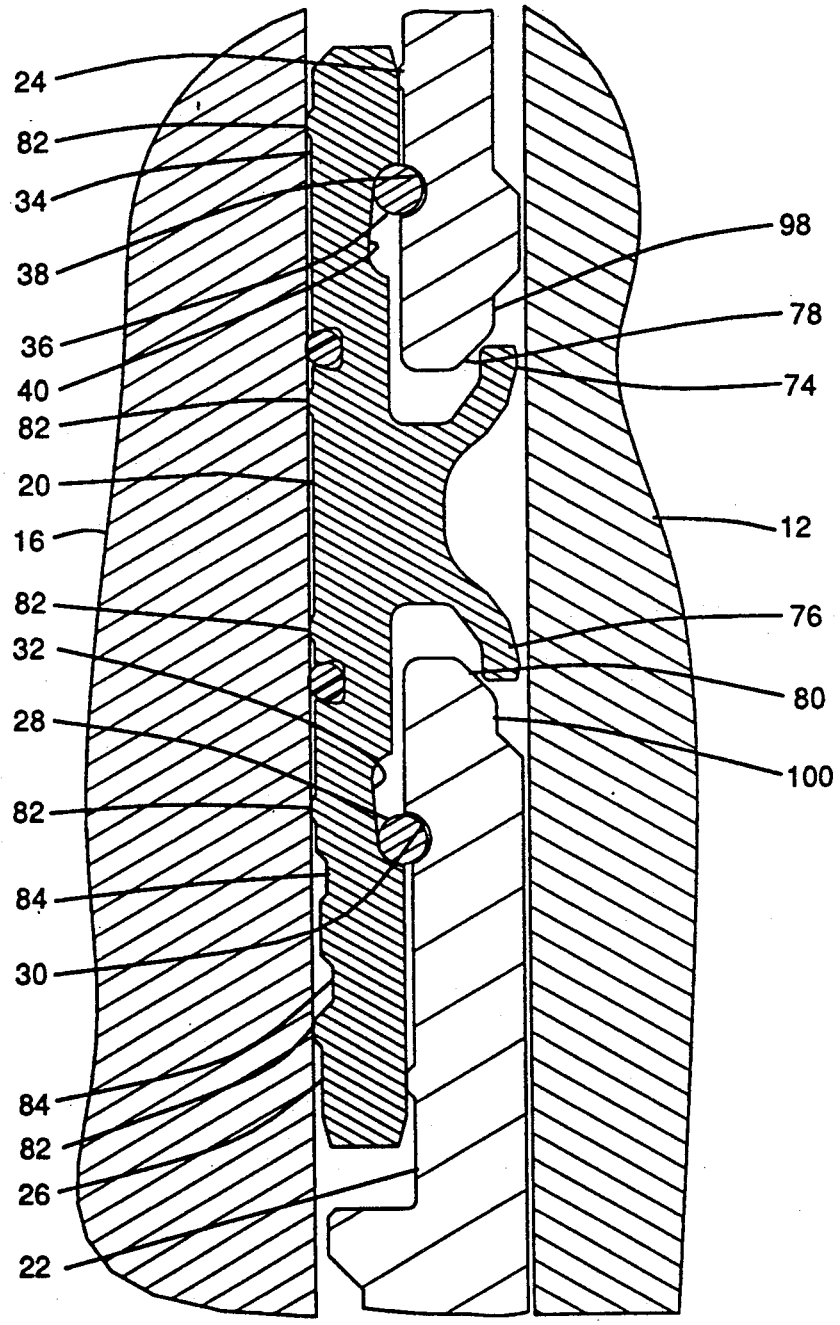
FIG. 3 is a detailed partial sectional view of the seal assembly of the present invention in its unset position.
Figure 3A:
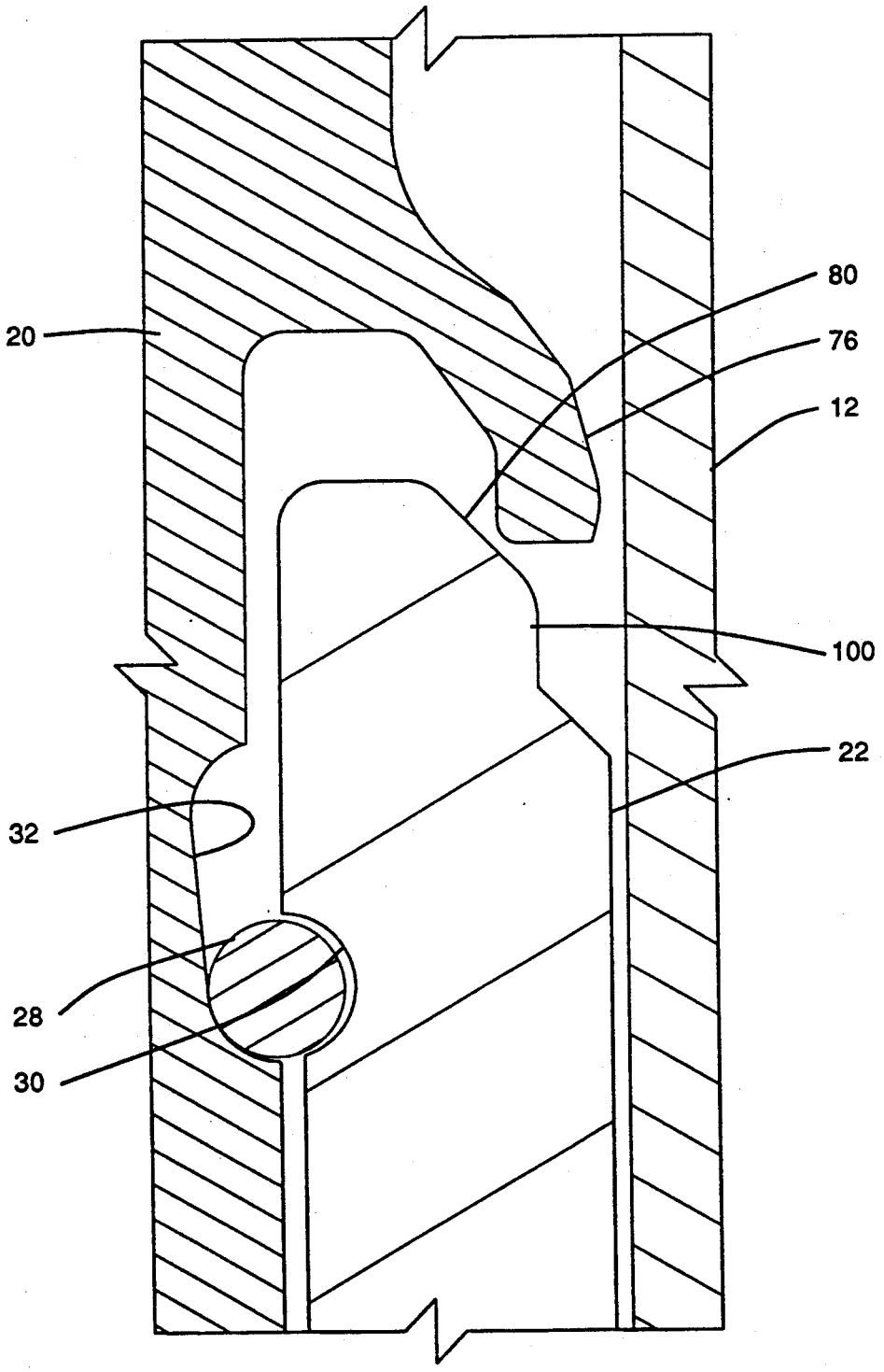
FIG. 3A is a partial enlarged sectional view of the lower seal lip and the energizing ring as shown in FIG. 3.

Improved seal assembly 10 of the present invention, as shown in FIG. 1, is illustrated while being lowered within well housing 12 and into annulus 14 between the interior of well housing 12 and the exterior of hanger 16 which has been landed within well housing 12. As shown in FIG. 1, hangers 16A and 16B have previously been landed within housing 12 and their respective seal assemblies 10A and 10B have been landed in the respective annuli 14A and 14B. Seal assembly 10 is supported from setting assembly 18 and setting assembly 18 is supported on a suitable tool (not shown) which can move the setting assembly 18 after landing into its set position as hereinafter described.

Seal assembly 10 includes annular body 20, lower energizer ring 22, and upper energizer ring 24. Lower energizer ring 22 is movably attached to lower rim 26 of body 20 by split ring 28 which is positioned in groove 30 on the interior of energizer ring 22 and in elongated groove 32 in the exterior of lower body rim 26. This allows relative axial movement of energizer ring 22 with respect to body 20. Upper energizer ring 24 is movably attached to upper rim 34 of body 20 by split ring 36 which is positioned in groove 38 on the interior of energizer ring 24 and in elongated groove 40 on the exterior of upper body rim 34. This allows relative axial movement of energizer ring 24 with respect to body 20. Windows 42 are provided in upper energizer ring 24 with exterior split locking ring 44 and interior split locking ring 46 positioned around ring 24 and biased inwardly and outwardly respectively. Wedge elements 48 are positioned within windows 42 immediately above exterior split locking ring 44 during running and have a lower outer tapered surface 50 which coacts with upper inner tapered surface 52 on exterior split locking ring 44. Ring 54 is positioned within energizer rim 66 of ring 24 and is secured by cap screws 56, or other suitable securing means, to wedge elements 48 as shown. Ring 54 includes lower tapered surface 58 which coacts with upper outer tapered surface 60 on split locking ring 46 as hereinafter explained. Ring 54 includes inner flange 62 and upper surface 64 which during running is at approximately the same level as upper surface 66 on upper energizer ring 24.

When seal assembly 10 is landed with the lower end of lower energizer ring 22 on the exterior shoulder 68 provided by hanger 16, setting is accomplished by causing the setting tool to push downwardly on the upper surface 66 of upper energizer ring 24. After setting is complete as hereinafter described, then pushing downwardly on ring 54 causes exterior split locking ring 44 to be wedged outward into internal housing groove 70 and interior split locking ring 46 to be wedged inwardly into hanger groove 72 to lock seal assembly 10 in its landed and set position.

Seal body 20 includes upper annular lip 74 and lower annular lip 76. Upper annular lip 74 extends outward from the exterior of body 20 and then curves to a generally axial upward position. Lower annular lip 76 extends outward from the exterior of body 20 and then bends to a generally axial downward position. In running position the exterior diameter of lips 74 and 76 is smaller than the inner diameter of housing 12. Upper energizer ring 24 has its inner surface spaced slightly outward from the exterior surface of upper rim 34 and a lower tapered surface 78 which engages the inner surface of upper lip 74 during setting to move it radially outward to the set position in metal-to-metal sealing engagement with the interior surface of housing 12. Lower energizer ring 22 has its inner surface spaced slightly outward from the exterior surface of lower rim 26 and an upper tapered surface 80 which engages the inner surface of lower lip 76 during setting to move it radially outward to the set position in metal-to-metal sealing engagement with the interior surface of housing 12.

One of the improvements of the present invention is the use of a high yield strength steel for energizer rings 22 and 24 and using a lower yield strength steel for upper and lower lips 74 and 76. This allows lips 74 and 76 to have sufficient give when forced against the interior of housing 12 to flow into the flaws and irregularities of such surface and ensure that there is complete metal-to-metal sealing. With the high yield strength energizer rings 22 and 24, they are subjected to a slight inward bend at their extremities as shown in FIG. 4A. This effectively stores the setting forces to ensure continued sealing of lips 74 and 76 against the interior of housing 12.

The interior of body 20 includes a series of annular ridges 82 separated by grooves 84. The inner diameters of ridges 82 are smaller than the diameter of the exterior portion of hanger 16 against which seal body 20 is to engage and seal. Care should be taken with the depth of grooves 84 to avoid problems with the build-up of pressure in liquids trapped therein during setting so that the sealing loads of the ridges 82 are not reduced thereby. It is preferred that if the grooves 84 have a radial dimension of approximately 0.005" a water exclusion material or a volume compensating material (such as a plurality of microspheres in an epoxy matrix) should be provided in grooves 84 so that the water pressure developed therein does not interfere or lessen the sealing load of the ridges 82 against the exterior surface of hanger 16. If there is some objection to the use of such materials, then it is suggested that the depth of grooves 84 be at least 0.040". Upper resilient sealing ring 86 is positioned in upper groove 88 and lower resilient sealing ring 90 is positioned in lower groove 92. Sealing rings 86 and 90 provide supplemental sealing between the interior of seal body 20 and the exterior of hanger 16.

Figure 4:
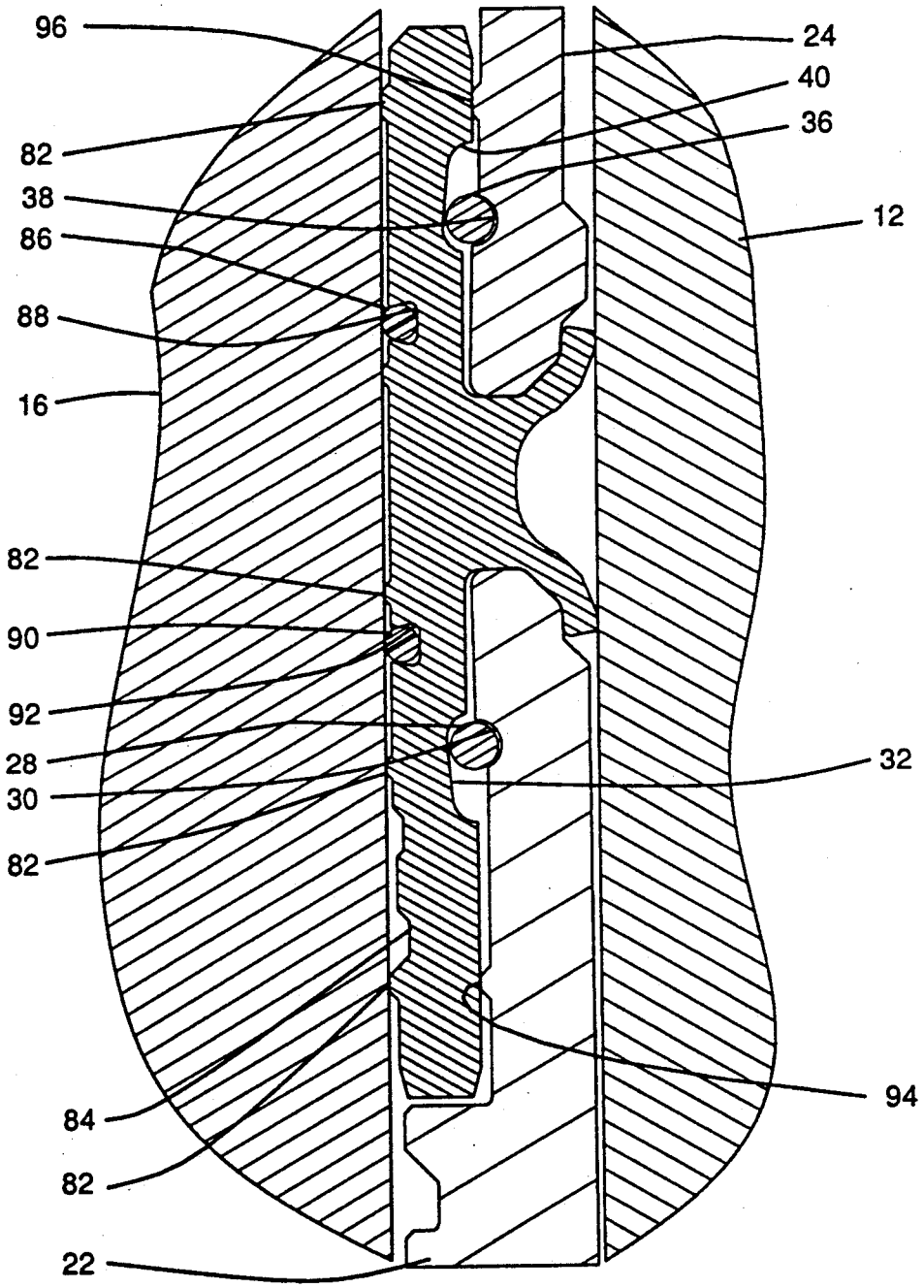
FIG. 4 is a detailed partial sectional view of the seal assembly shown in FIG. 3 after it has been moved to its set position.
Figure 4A:
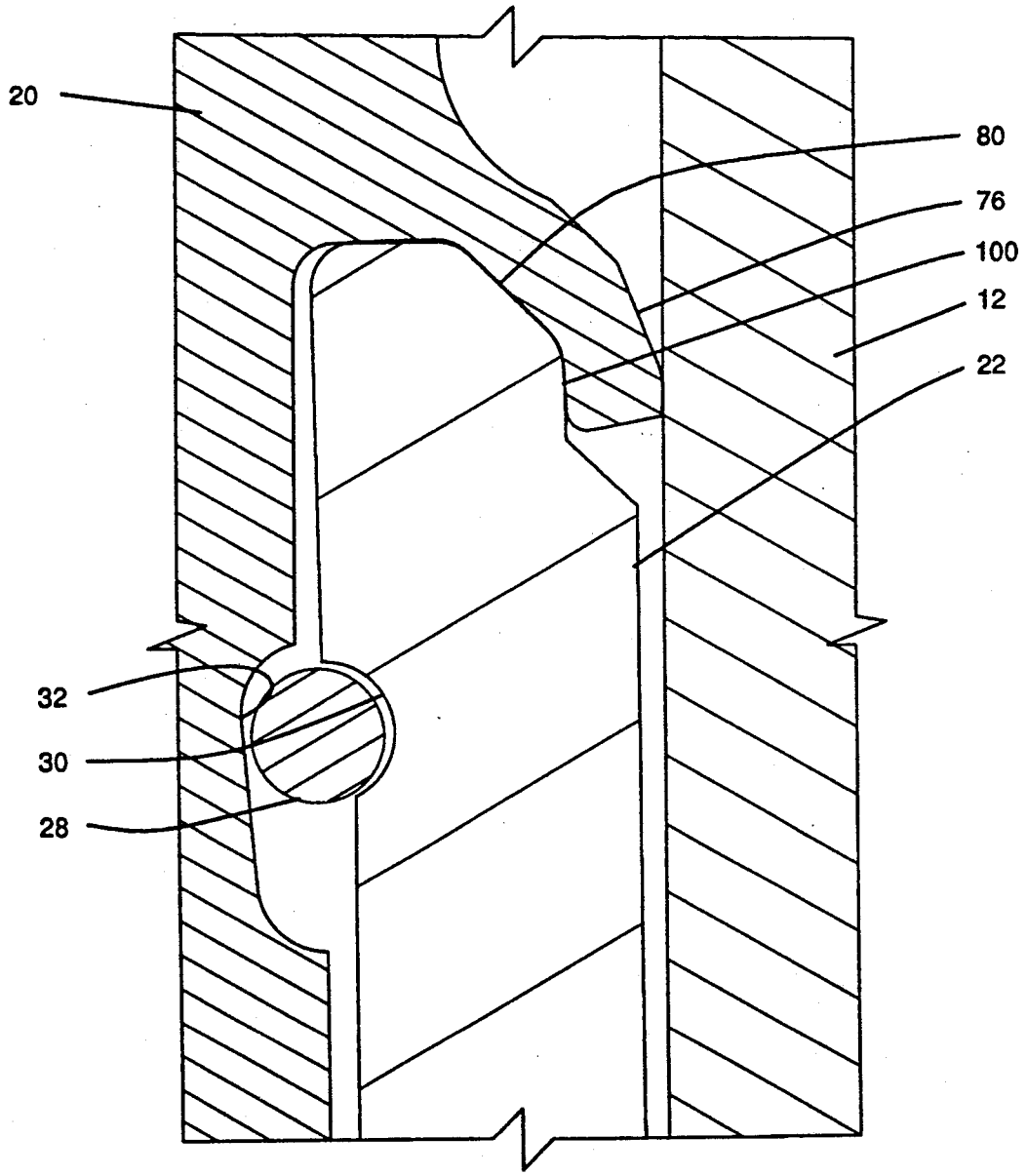
FIG. 4A is a partial enlarged sectional view of the lower seal lip and its energizing ring as shown in FIG. 4.

It should be noted that in order to ensure engagement of the ridges 82 with the exterior portion of hanger 16 the interior portions of energizer rings 22 and 24 are provided with inwardly extending projections 94 and 96, respectively, which are positioned immediately outside of lower and upper ridges 82 when seal assembly 10 is set as shown in FIG. 4. Projections 94 and 96 have a radial dimension which ensures that upper and lower ridges 82 are in sealing engagement with the exterior portion of hanger 16.

With the configuration of the wedging ends of energizer rings 22 and 24 the forces exerted on sealing lips 74 and 76 are exerted by the axially extending surfaces 98 and 100. This causes only radial forces to be exerted on lips 74 and 76 so that there is no axial force tending to urge the energizer rings axially away from the sealing lips.

What is claimed is:

1. A sealing assembly for sealing between an interior sealing surface of a well housing and an exterior sealing surface of a hanger landed within the well housing comprising an annular seal body having an outer seal lip, and a plurality of inner ridges, an energizer for engaging the outer seal lip and urging it outwardly into sealing engagement with the interior sealing surface of the housing, said energizer including means for storing the energy of moving radial sealing lip into its sealing position so that the force is maintained on the lip.

2. A sealing assembly according to claim 1 wherein said energy storing means includes a portion of said energizer being designed to undergo elastic deformation during the moving of the seal lip.

3. A sealing assembly according to claim 1 wherein said energizer is of a material which has a relatively higher yield strength than the material of the seal lip.

4. A sealing assembly according to claim 1 wherein said energizer has an upstanding rim which engages said lip and the outer end of the rim is free of internal support to allow elastic deformation inwardly when subjected to the lip moving force to provide the storing of the energy of moving the lip into sealing engagement.

5. A sealing assembly according to claim 1 wherein said energizer has a tapered surface on its upper end, the tapered surface of said upper end engages within its seal lip and is subject to bending inwardly during the moving of the lip into sealing position to store the energy of moving the lip.

6. A sealing assembly according to claim 1 wherein said inner ridges having grooves therebetween and an inner diameter which is smaller than the outer diameter of the hanger sealing surface.

7. A sealing assembly according to claim 6 including means for preventing excessive pressures being generated in liquids trapped in the grooves between the ridges.

8. A sealing assembly according to claim 7 wherein said excess pressure prevention means includes a water exclusion material in said grooves.

9. A sealing assembly according to claim 7 wherein said excess pressure prevention means includes having the depth of the grooves being at least 0.040 inches.

10. A sealing assembly according to claim 7 wherein said energizer includes means for preventing its retraction from its setting engagement with said seal lip.

11. A sealing assembly according to claim 1 wherein said energizer includes an annular body and a tapered surface at a position spaced from said annular body for engaging and moving said seal lip.

12. A sealing assembly for sealing between an interior sealing surface of a well housing and an exterior sealing surface of a hanger landed within a radial sealing well housing comprising an annular seal body having an outer upper seal lip, and outer lower seal lip and a plurality of inner ridges, an upper energizer for engaging the upper seal lip and urging it outwardly into sealing engagement with the interior sealing surface of the housing, a lower energizer for engaging the lower seal lip and urging it outwardly into sealing engagement with the sealing surface of the housing, and said energizers including means for storing the energy of moving the lips into their sealing positions so that the force is maintained on the lips.

* * * * *